US005435331A

United States Patent [19]

Okuda

[11] Patent Number: 5,435,331

[45] Date of Patent: Jul. 25, 1995

[54] WINDPROOF UMBRELLA

[76] Inventor: Yukihiro Okuda, 4-3, 1-Chome Sugi, Hirakata City, Osaka, Japan

[21] Appl. No.: 287,892

[22] Filed: Aug. 9, 1994

[30] Foreign Application Priority Data

Nov. 22, 1993 [CN] China ..... 93244398.2

[51] Int. Cl.[6] ..... A45B 25/00

[52] U.S. Cl. ..... 135/29; 135/31

[58] Field of Search ..... 135/25.3, 25.31, 29, 135/31, 25.34, 32

[56] References Cited

U.S. PATENT DOCUMENTS

| | | | |
|---|---|---|---|
| 1,083,050 | 12/1913 | Bialozyt | 135/31 X |
| 3,893,467 | 7/1975 | Wingen | 135/29 X |
| 4,007,752 | 2/1977 | Weber | 135/29 X |
| 4,838,290 | 6/1989 | Wu | 135/25.31 |
| 5,063,953 | 11/1991 | Wu | 135/31 X |
| 5,337,770 | 8/1994 | Wang | 135/31 X |

*Primary Examiner*—Lanna Mai
*Attorney, Agent, or Firm*—Bacon & Thomas

[57] ABSTRACT

The tension members in a collapsible umbrella are each provided at the opposite ends with upwardly bent loops that are pivotally connected to a stay and an inner end of a joint member so that when the umbrella is turned inside out by a gust of wind, the tension members are caused to bend downwardly and be stably received within the struts to avoid displacement of the joint members. The downward bending of the tension members place same under considerable tension for urging the joint members upwardly when the umbrella slider is pulled downwardly, thereby restoring the umbrella to its original condition. The joint members are further provided with curved upper portions for permitting the umbrella ribs to cluster more closely around the umbrella shaft for storage.

2 Claims, 4 Drawing Sheets

8
7
P
P2
3
6
2
4
P1
5
11
12
1
W
9

3
4
5
6
7
8
9
11
12

WINDPROOF UMBRELLA

This invention relates to a windproof umbrella which can be automatically restored to its normally closed condition after its cover tarried over due to strong wind, by simply operating the slider downwardly along the shaft as in the fashion of closing the normally opened umbrella into the closed condition.

The windproof umbrella of the afore said type is known and characterized in forming a crooked portion at the intermediate of a tension member whose ends being pivotedly connected to a joint member and a stay, respectively. Said tension wire, when the slider is pulled downward along the shaft, will be bent with the said crooked portion positively and definitely positioned outside of the line connecting the said two pivoted points, namely positioned closely toward the cover side. This windproof umbrella restores to its closed condition by means of the tension member which urges the joint to drive the spoke connected to the outer end thereof to gradually turn same toward inner side and thereby resume the normally closed condition. In other words, the said umbrella restores its normally closed condition solely by means of the tension member acting on the joint member. However, the tension member is liable to get very much curved toward the cover side when the slider is pulled downward and can not come back straight and therefore the umbrella can not close nicely. The bent tension members result in failure to obtain the desired function of the automatic restoration of normally closed condition from the turned over condition.

In order to eliminate the shortcomings of said umbrella, the present inventor had designed an improved umbrella of the same type as that of prior patent wherein a joint having a projection formed at the lower edged portion is provided to allow the projection to be received in the groove formed on the strut during the operation for restoring the umbrella ribs to thereby prevent the joint member from displacement or being biased. In addition, setting the pivot point(P) of the joint member with the tension wire at a position outside of the connecting line of the pivot point($P_2$) of the joint member with the strut and the pivot point($P_1$) of the stay with the-tension member, so that when the umbrella is restored from the turned over condition to the normally closed condition, the tension member properly acts on the point(P) with its restoring force on it to push the joint member upwardly; thus as a consequence the joint member together with the spoke smoothly turns and restores to their normally closed position. However, in such structure, when the spoke is made with a high strength material, the force applied on the point(P) would frequently cause the joint member to swing, resulting in a displacement of the joint member and prevent the smooth restoration of the spokes to a normal position. Further, there needs a rather big force in such structure to ensure the upward movement of the point(P).

In accordance with the present invention, there is provided an improved rib structure of the umbrella of the above mentioned type, which comprises an improved joint member and an improved tension member forming a five member-rib structure, where the tension member plays a leading role in the operation of the restoration of the umbrella from the turned over condition to the normally closed condition. In this invention, a straight resilient member, preferably a steel wire of an appropriate size is used as the tension member, which is characterized by bending both ends of the tension wire upwardly into a loop and pivotally securing the loops to the joint member and the stay, respectively. The tension wire will automatically be curved and a major portion thereof is received in the groove of the strut when the umbrella is in the turned over condition. The tension wire in such condition stores a considerable energy which urges the joint member move upwardly when the slider moves downward along the shaft during the operation of the restoration of the umbrella. Since the tension wire is stably received in the groove of the strut, the swinging or displacement of the joint member in the prior art umbrellas can thus be avoided.

The present invention will now be described with reference to the accompanying drawings in which.

Figure 1:
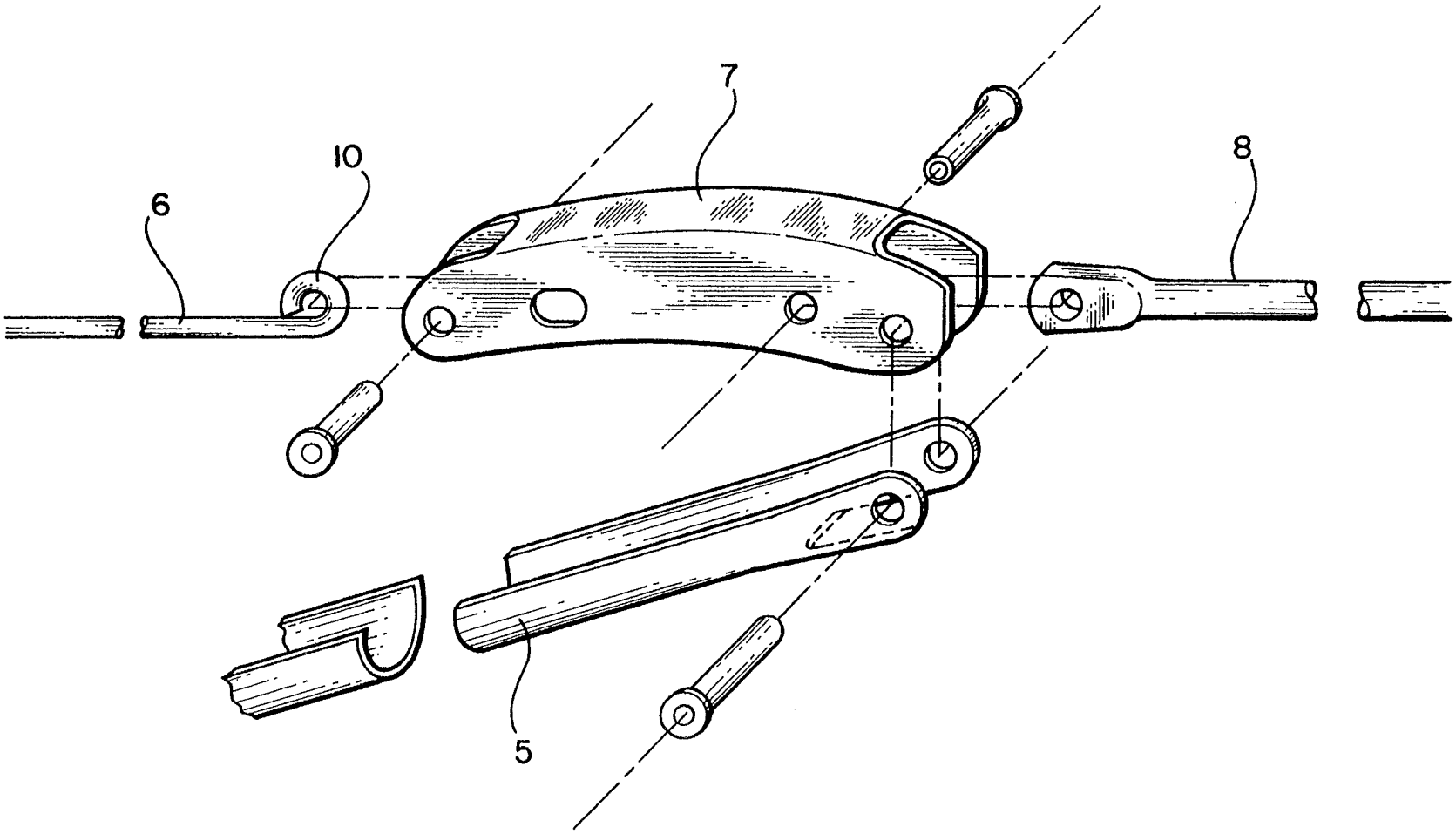
FIG. 1 is an exploded perspective illustration of the main portion of the umbrella of the invention.
Figures 2, 2A:
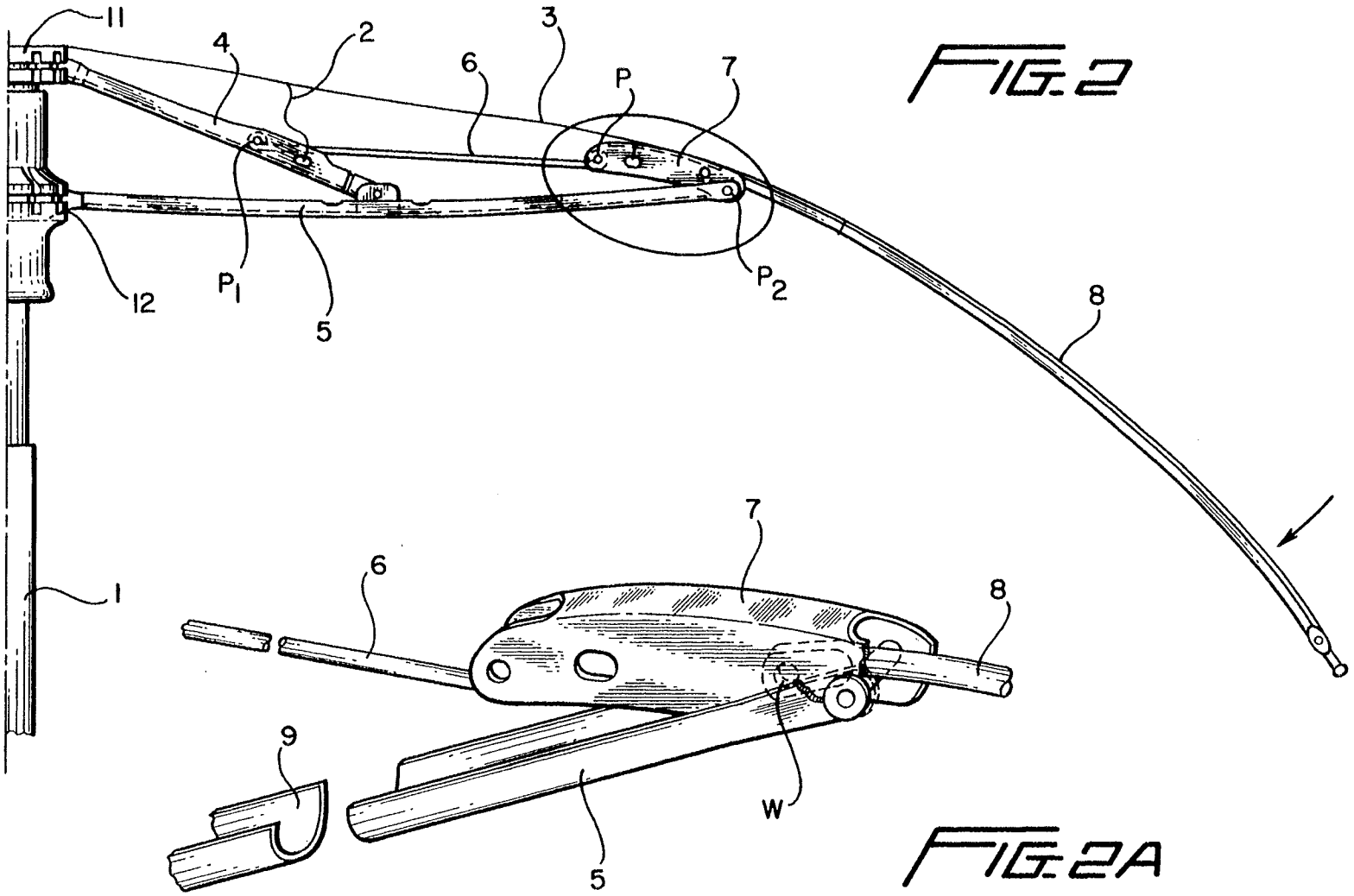
FIG. 2 is a partial front view of the umbrella in open condition, showing the improved portion of the invention with an enlarged view of the encircled portion.

As seen in FIG. 2 the umbrella according to the invention has in the known way a shaft, with a crown 11 secured to its upper end, a slider 12 slidably provided on the shaft, and ribs consisting of stays 4, struts 5, tension members 6, joint members 7 and spokes 8. Pivoted to the slider 12 are struts 5 with their outer ends linked through joint members 7 to the spokes 8. The inner ends of the stays 4 are linked to the crown 11 and the outer ends are pivotally connected to the intermediate of the struts 5. The tension members 6 have their inner ends linked to the intermediate of the stays at point $P_1$ and the outer ends linked to the inner ends of the joint members 7 at point P.

The improvement provided by the invention resides in the tension members 6 which is formed from a small sized resilient material, for instance, a straight steel wire having a diameter around 1 mm. The both ends of the tension member 6 are bent upwardly into loops 10 and pivotally connected to the stays 4 and the joint member 7 with the pivotal axes extending through loops 10, respectively at point $P_1$ and point P.

The joint member 7 according to the invention has a slightly curved upper portion and flat or a little inwardly curved lower edges.

Figures 3, 3A:
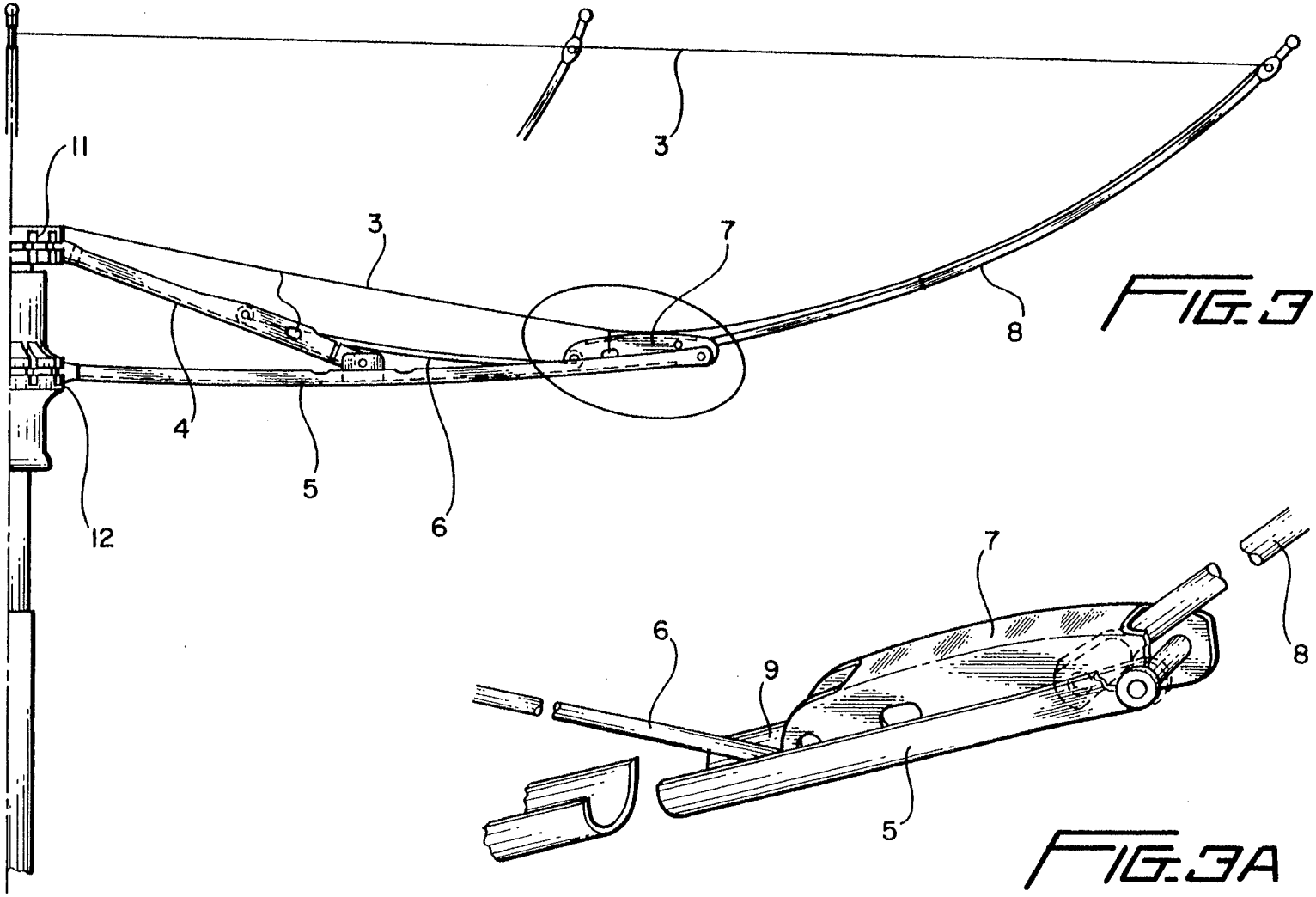
FIG. 3 is the turned over condition of the umbrella in partial view with an enlarged view of the encircled portion.
Figure 4:
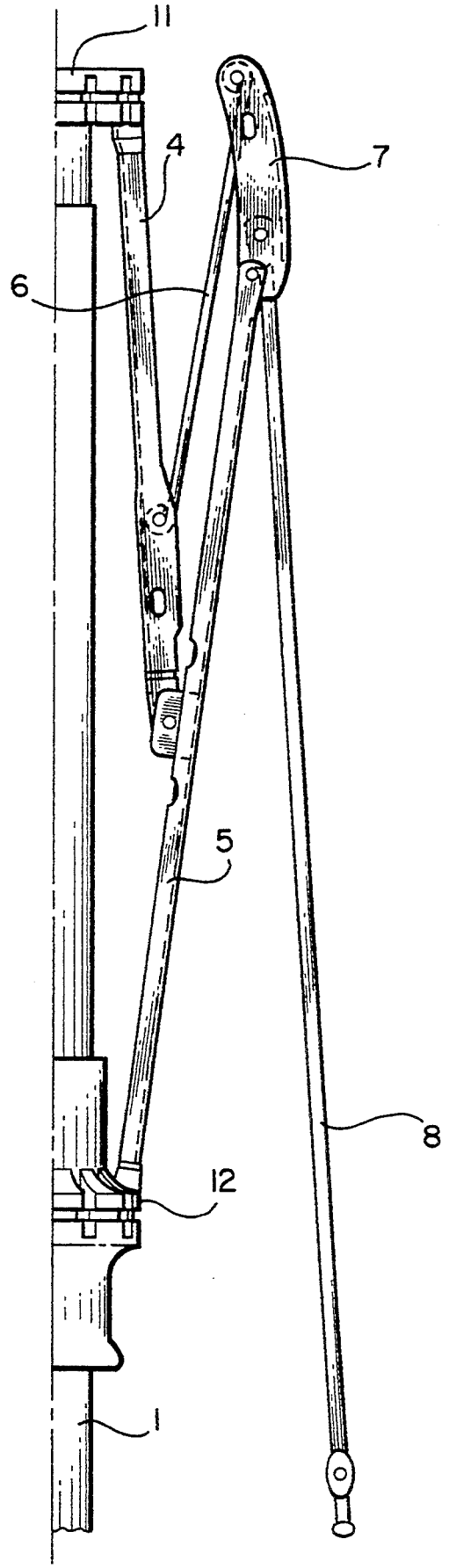
FIG. 4 is the closed ribs or skeleton of the umbrella of the invention in partial view.

The tension member 6 has been so constructed in the aforesaid manner, thus so that when the umbrella is subjected to a strong wind causing the umbrella to be turned over to take the position as represented in FIG. 3, the tension member 6 will be automatically curved downwardly and received in the groove 9 formed on the strut 5. During that time the joint member 7 will be seated stably in the groove 9 and avoiding displacement that would occur otherwise. In the operation of the umbrella from the turned over condition of FIG. 3 to the normally closed condition of FIG. 4, the slider 12 is simply moved downward along the shaft 1 as in the manner of closing the normal umbrella from an open condition to a closed condition, so that the tension member 6 urges the joint member 7 to move upward. As the result of this movement, the spoke 8 moves gradually downward to restore the normal condition and finally resumes the closed condition as shown in FIG. 4.

The tension member 6 when received in the groove 9 of the strut 5, is in a considerably energized or tensioned state that it may actively function on the joint member 7 to effect the desired restoration operation.

The joint member 7 with the curved upper portion assists the ribs to more closely cluster around the shaft 1 when the umbrella resumes its closed or collapsed position for storage thus, eliminating the superfluous work required in the prior umbrella.

What is claimed is:

1. In an umbrella of the type having a shaft, a crown, a slider movably supported on the shaft and a collapsible frame secured to the crown and slider, wherein the frame includes a plurality of struts, a plurality of stays, a plurality of tension members, a plurality of joint members and a plurality of spokes, with each strut having an inner end pivotally secured to the slider and an outer end pivotally secured to an outer end of a joint member, each stay having an inner end pivotally secured to the crown and an outer end pivotally secured to a strut intermediate the inner and outer ends of the strut, each tension member having an inner end pivotally secured to a stay intermediate the inner and outer ends of the stay and an outer end pivotally secured to an inner end of a joint member, and a rib secured to and extending outwardly from each joint member, the improvement comprising:

each tension member being formed of resilient material, the inner and outer ends of each tension member being bent upwardly to form loops through which the pivotal axes with the stay and joint member extend so that when the umbrella frame is turned inside out, the tension members are curved downwardly and received within the struts under tension for urging the joint members upwardly when the slider is pulled downwardly on the shaft, thereby restoring the umbrella to its original condition.

2. The umbrella of claim 1 wherein each joint member includes a curved upper portion for permitting the ribs to cluster closely around the shaft when the umbrella is disposed in a collapsed condition.

* * * * *